US007739840B1

(12) United States Patent
Castellanos

(10) Patent No.: US 7,739,840 B1
(45) Date of Patent: Jun. 22, 2010

(54) ROOF HIP AND RIDGE ANCHOR DEVICE

(76) Inventor: Tom Castellanos, 2301 W. 8th La., Hialeah, FL (US) 33010

( * ) Notice: Subject to any disclaimer, the term of this patent is extended or adjusted under 35 U.S.C. 154(b) by 561 days.

(21) Appl. No.: 11/614,190

(22) Filed: Dec. 21, 2006

(51) Int. Cl.
*E04D 1/34* (2006.01)

(52) U.S. Cl. ..... 52/57; 52/465; 52/198

(58) Field of Classification Search ..... 52/41, 52/42, 43, 44, 57, 90.1, 198, 199, 302.1, 52/302.3, 465
See application file for complete search history.

(56) References Cited

U.S. PATENT DOCUMENTS

| | | | | |
|---|---|---|---|---|
| 1,093,201 | A * | 4/1914 | Owen | 52/42 |
| 4,280,399 | A * | 7/1981 | Cunning | 454/365 |
| 6,647,675 | B1 * | 11/2003 | Castellanos | 52/198 |
| 7,013,610 | B2 * | 3/2006 | Kunz | 52/255 |
| 2006/0048460 | A1 * | 3/2006 | Schwind | 52/86 |
| 2007/0094948 | A1 * | 5/2007 | Osborne et al. | 52/90.1 |

* cited by examiner

*Primary Examiner*—Brian E Glessner
*Assistant Examiner*—Patrick Maestri
(74) *Attorney, Agent, or Firm*—Sanchelima & Assoc., P.A.

(57) ABSTRACT

A device for roof structures having a ridge or hip defined by the planes of two roof decks, disposed at an angle with respect to each other defining a longitudinal joint. A longitudinally extending cover with at least one coextensive channel defined by a bottom, two spacer walls and two lateral walls are mounted over the ridge or hip. The channel(s) increases the effective contact area to enhance the gripping action of the adhesive compound. From the longitudinal bends of the cover wall extend two perpendicularly extending walls with distal ends that continue with longitudinally coextensive flanges. The longitudinal flanges extend at an angle to be cooperatively and rigidly mounted over the roof decks with mechanical fasteners. An adhesive compound is positioned in the channel and over the cover. The adhesive is pressed so that part of it protrudes through the through openings positioned along the bottom, spacer and lateral walls that define the channel thereby creating a mechanical anchorage with the device. Tile accessories are placed over the cover and in contact with the adhesive compound to secure them to the device.

6 Claims, 6 Drawing Sheets

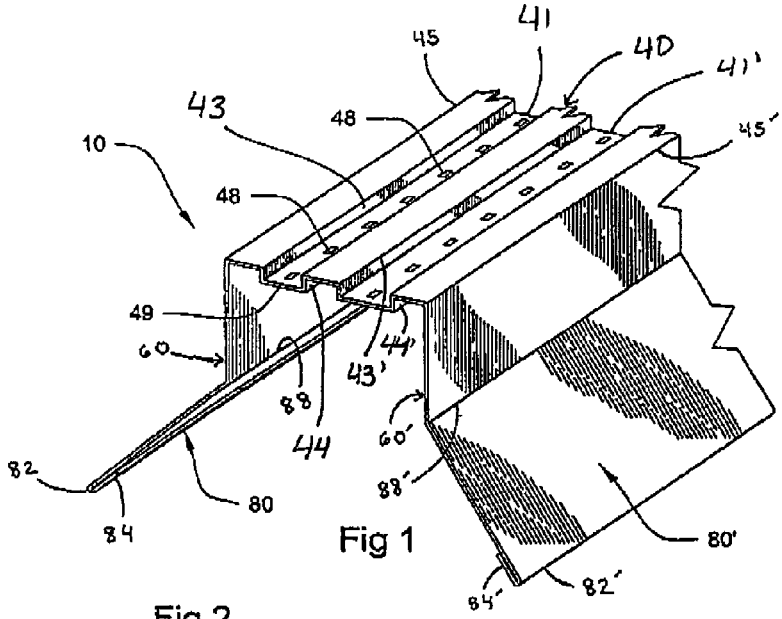
Fig 1
Fig 2
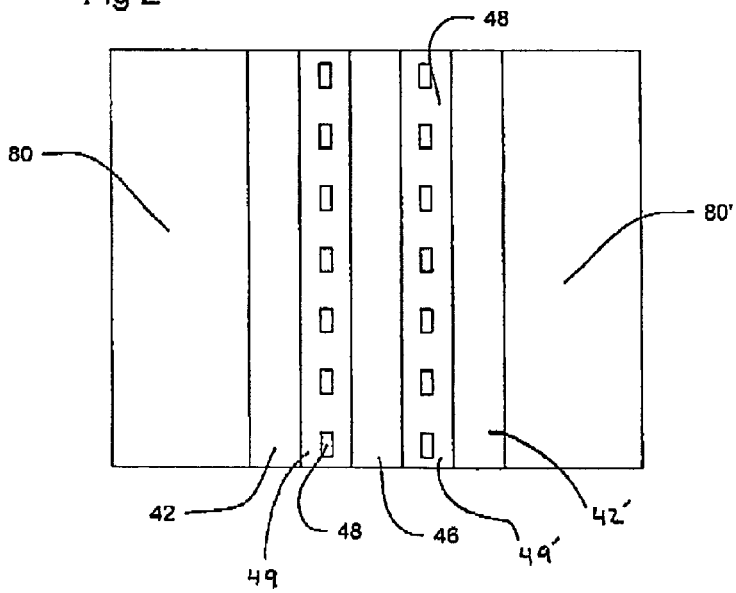

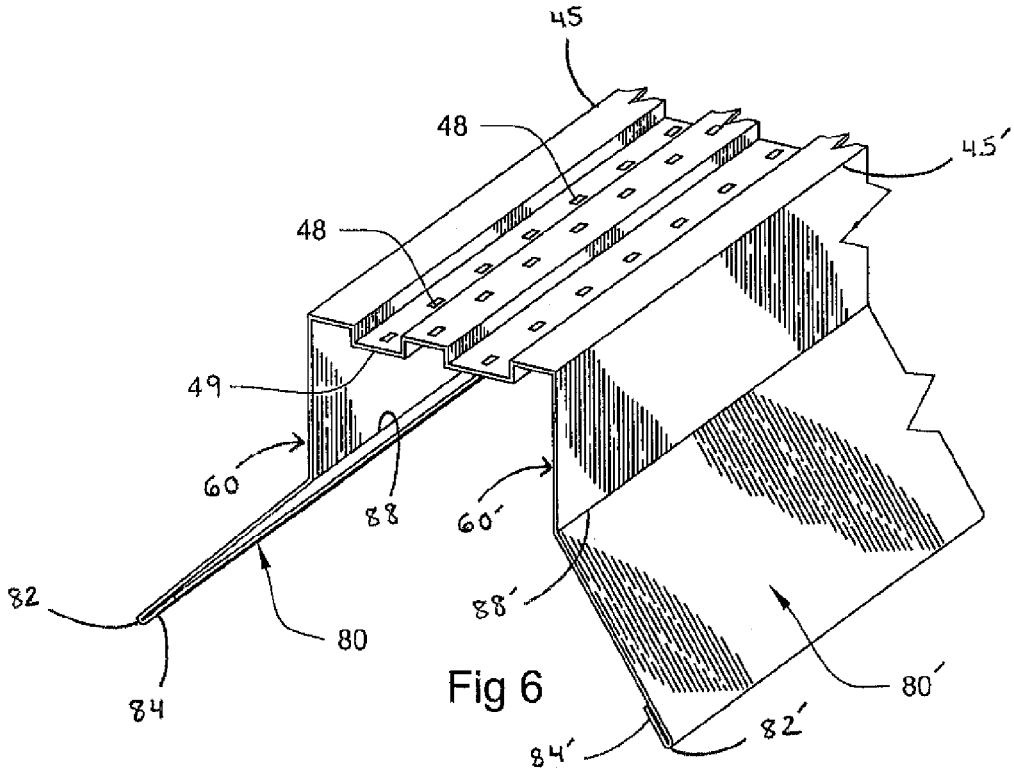
Fig 6
Fig 7
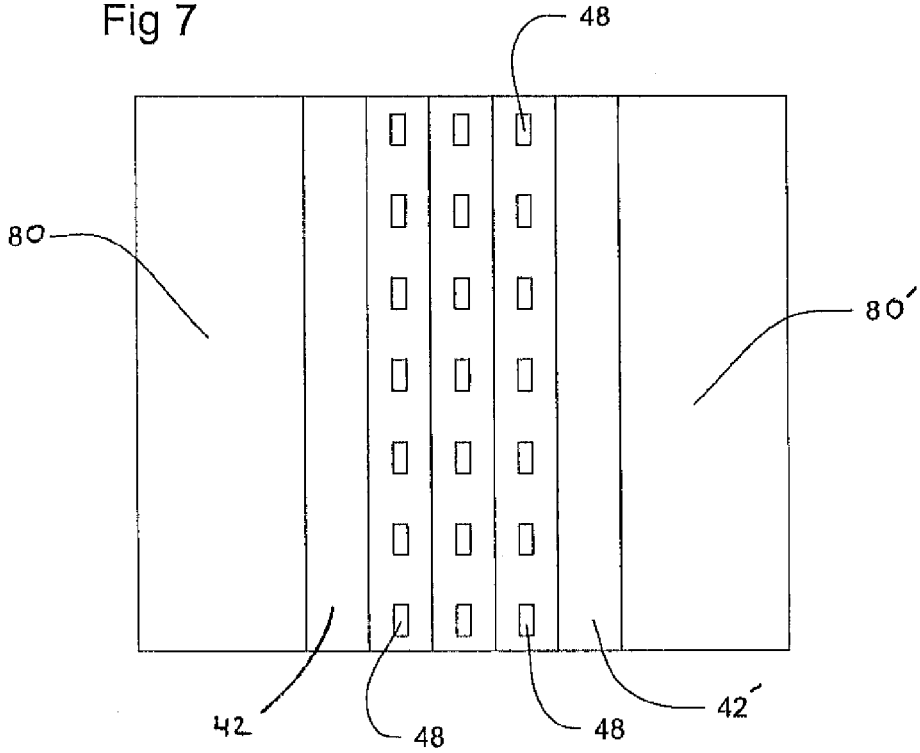

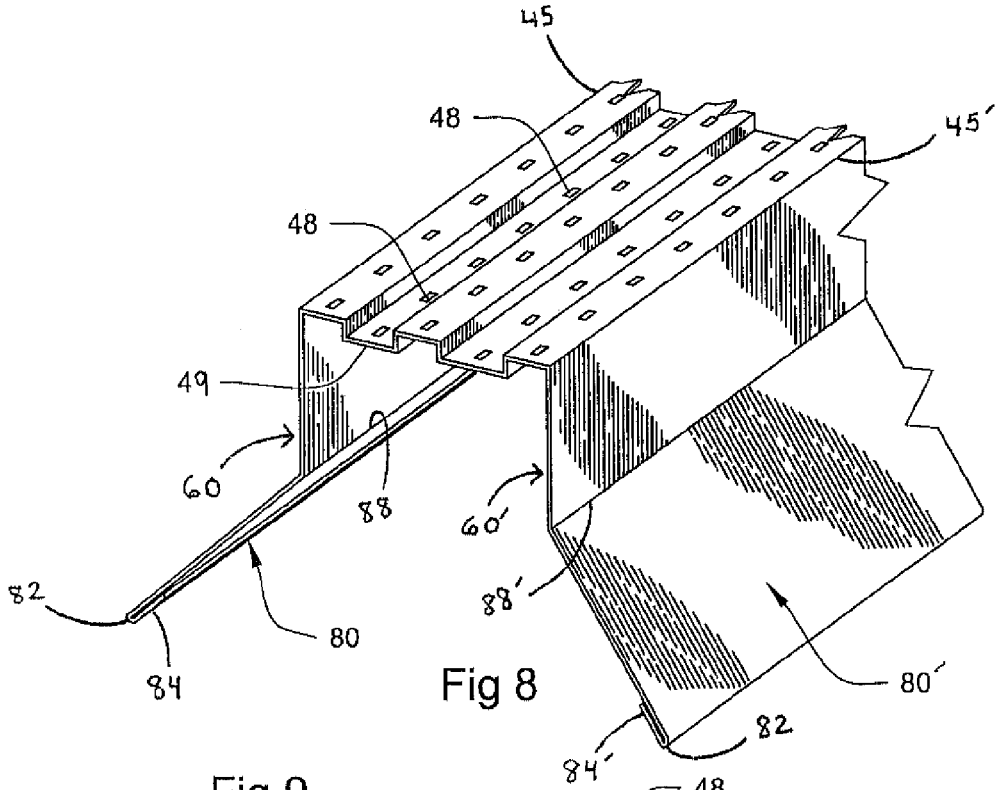
Fig 8
Fig 9
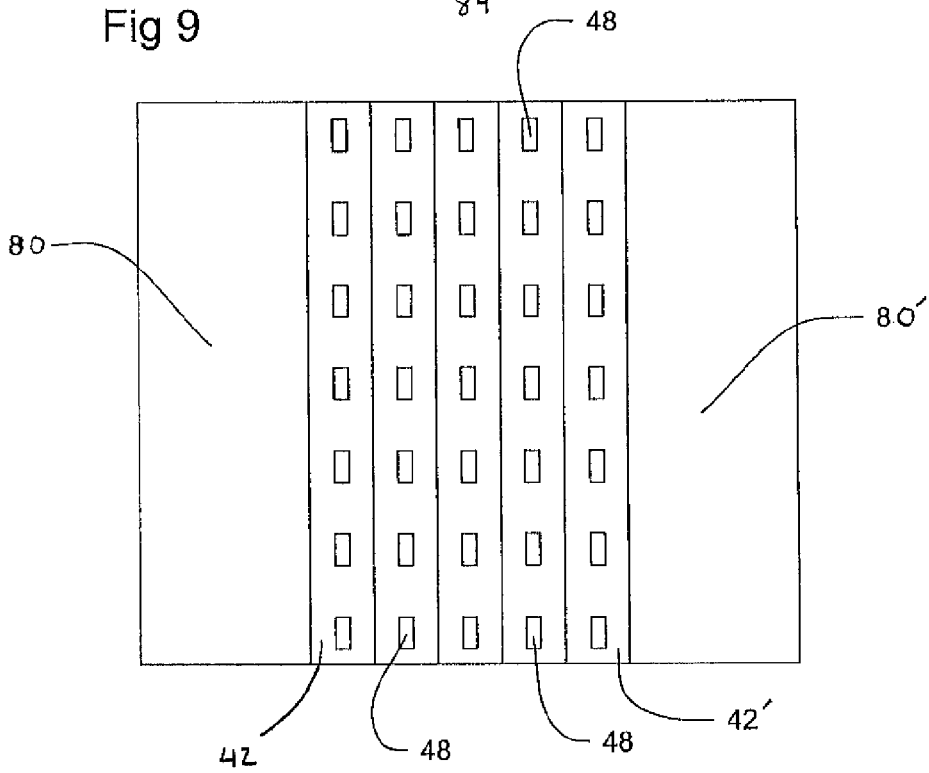

ROOF HIP AND RIDGE ANCHOR DEVICE

BACKGROUND OF THE INVENTION

1. Field of the Invention

The present invention relates to a hip and ridge attachment device for roof construction, and more particularly, to such a device that is used in conjunction with an adhesive compound to secure the tiles to the device which in turn is mechanically anchored to the roof structure.

2. Description of the Related Art

Several designs for hip and ridge devices have been designed in the past. None of them, however, includes the anchorage features of the present invention while simultaneously keeping the design compatible with roll forming manufacturing processes. Roll forming techniques are suitable for relatively inexpensive production operations but carry inherent limitations. The present invention reconciles these limitations with a sturdy design that results in an article of manufacture that can withstand the most exigent wind pressures to which a roof envelope is exposed.

Applicant believes that the closest reference corresponds to U.S. Pat. No. 6,647,675 issued to the inventor herein on Nov. 18, 2003. However, it differs from the present invention because even though the contact area was increased, it fails to provide the mechanical anchorage between the adhesive compound and the device that results in the wind pressure advantages of the present invention.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a roof hip and ridge attachment device that is compatible with roll forming manufacturing processes while simultaneously providing the mechanical anchorage features to withstand wind forces to which roofs may be exposed.

It is another object of this invention to provide a device that maximizes the contact area with the adhesive compound with longitudinally extending channels and cooperatively positioned through openings that permit the adhesive compound to go through.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 shows an isometric view of one of the preferred embodiments with two longitudinally extending channels and openings through the bottom walls of the channels.

FIG. 2 is a top view of the device shown in FIG. 1.

FIG. 6 shows an isometric representation of still another embodiment with through openings through the longitudinal bottom walls of the channels and the central spacer wall separating the channels.

FIG. 7 is a top view of the device shown in FIG. 6.

FIG. 8 is an isometric view of another embodiment with two longitudinal channels with through openings through the coextensive bottom and the central and side spacer walls.

FIG. 9 is a top view of the device shown in FIG. 8.

DETAILED DESCRIPTION OF THE PREFERRED EMBODIMENT

Figure 3:
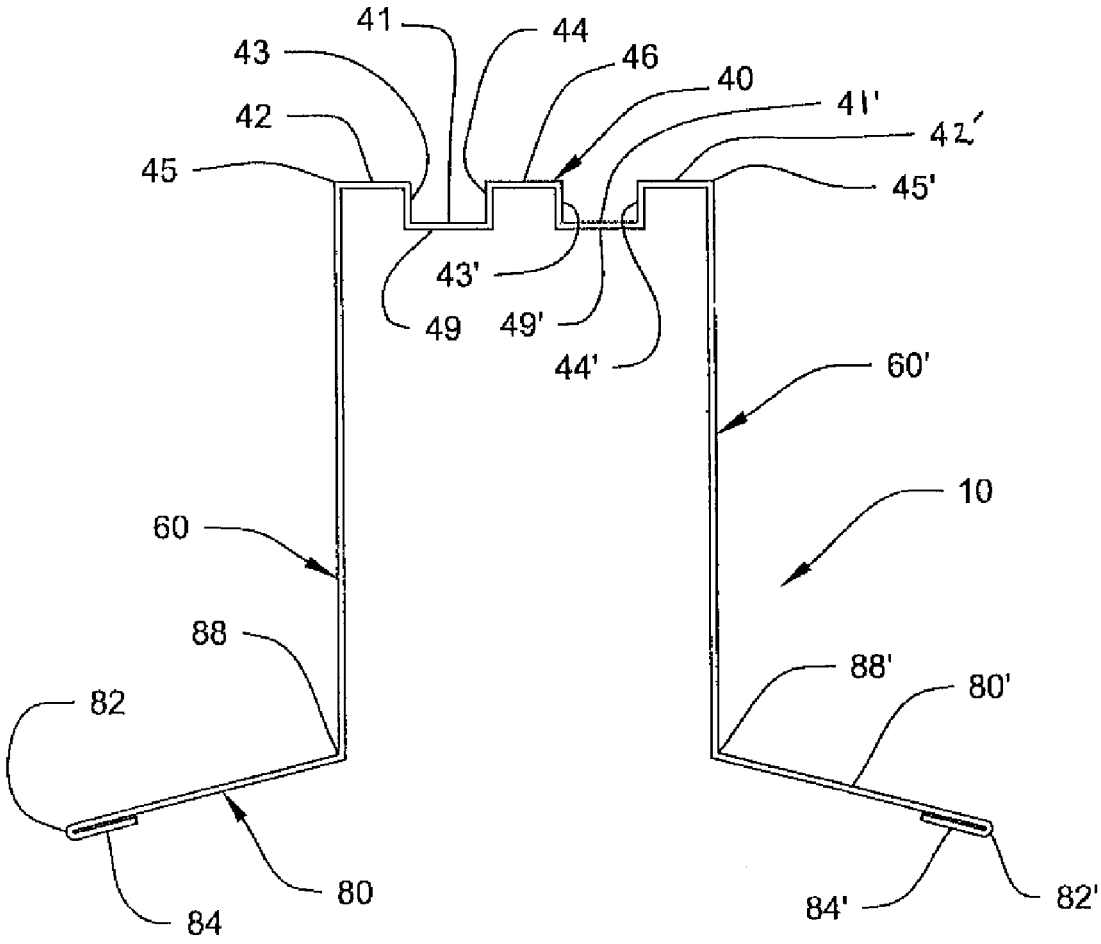
FIG. 3 represents an elevational end view of the embodiment shown in the previous two figures.

Referring now to the drawings, where the present invention is generally referred to with numeral 10, it can be observed that it basically includes an elongated cover 40, with longitudinal bends 45 and 45' from where coextensive elongated spaced apart walls 60 and 60' extend ending with longitudinally extending flange members 80 and 80' at an angle that start starts from longitudinal bends 88 and 88' that in turn terminate with flange folds 84 and 84' defining flanges' distal folded ends 82 and 82'. The angle of flange members 80 and 80' with respect to walls 60 and 60' varies depending on the pitch of the roof structure to which the former are mounted.

Figure 4:
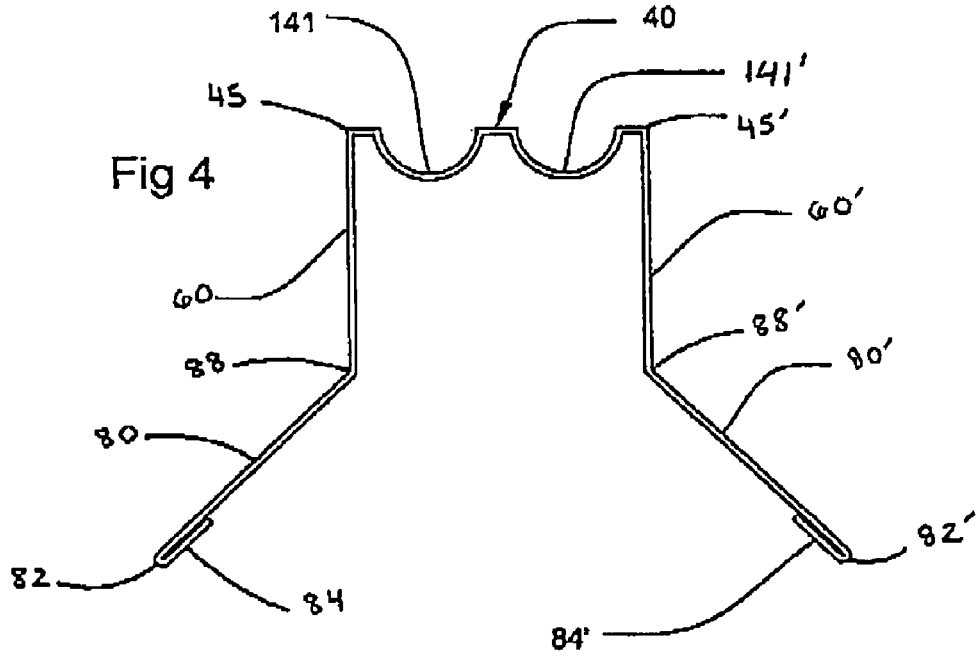
FIG. 4 illustrates an alternate embodiment with the channels' cross-section having a different shape.
Figure 5:
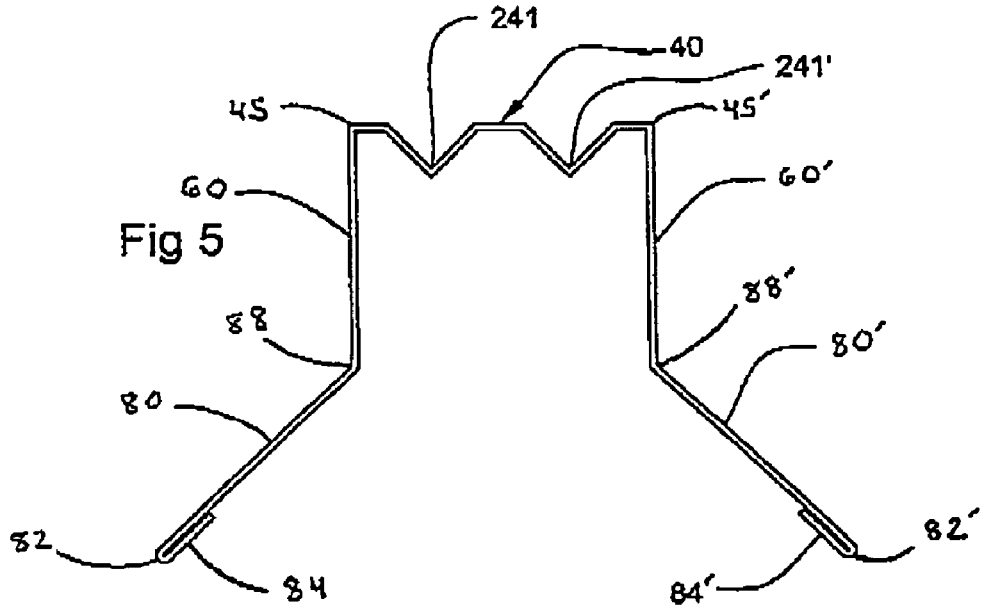
FIG. 5 is a representation of still another embodiment with two spaced apart channels with a triangular cross-section.

Cover 40, in one of the preferred embodiments, as shown in FIGS. 1; 2 and 3 includes two coextensive channels 41 and 41' defined by lateral walls 43; 44 and 43' and 44', respectively, separated by coextensive bottom walls 49 and 49'. Channels 41 and 41' are separated from each other by longitudinal central spacer wall 46 and to the longitudinal edges 45 and 45' by longitudinal spacer walls 42 and 42', in this embodiment. FIGS. 4 and 5 show other variations of these two channels with different cross-sectional shapes, with equivalent results. These shapes are all compatible with roll forming techniques. The objective being to increase the effective contact area of channels 41; 41'; 141; 141'; 241; 241' for the mortar or adhesive compound used and to provide a structural locking engagement with the mortar or adhesive compound protruding through openings 48.

Openings 48 permit the mortar or adhesive compound to go through thereby enhancing the anchorage engagement. The mortar or adhesive compound is flattened when the underside of tile T comes in contact with the former, causing it to extrude through openings 48.

The embodiment shown in FIGS. 6 and 7 are similar to the one illustrated in FIGS. 8 and 9, except that openings 48 have been included along spacer walls 42 and 42'.

Figure 10:
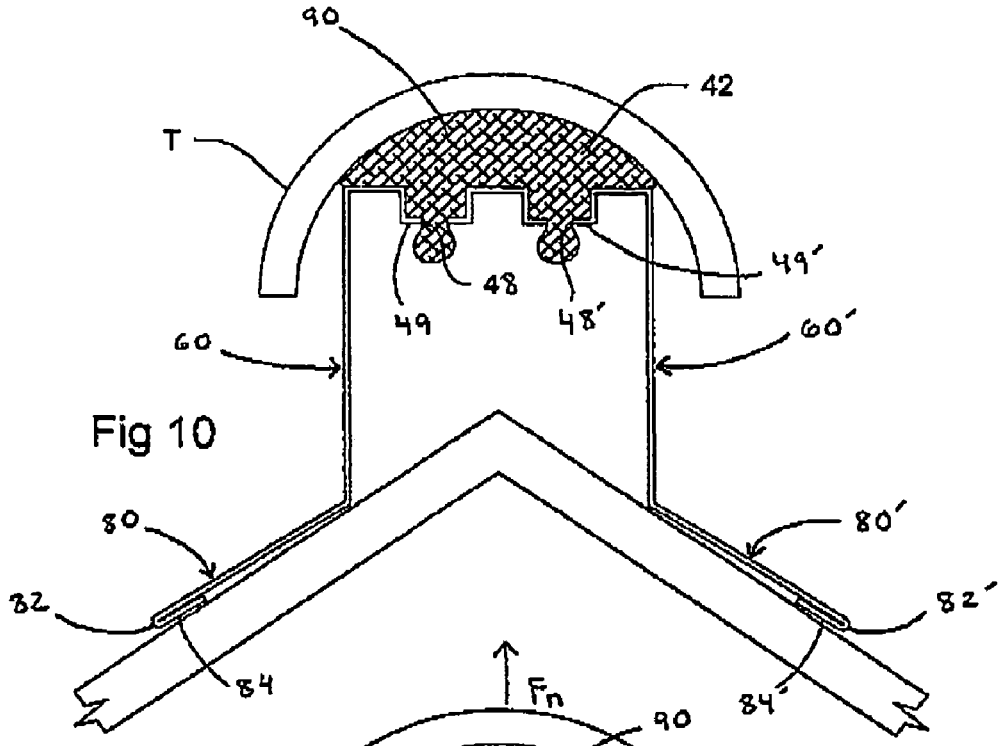
FIG. 10 is an elevational end view representation of the embodiment shown in FIG. 1 with mortar applied on its channels and being pressed through the openings by tile T.
Figure 11:
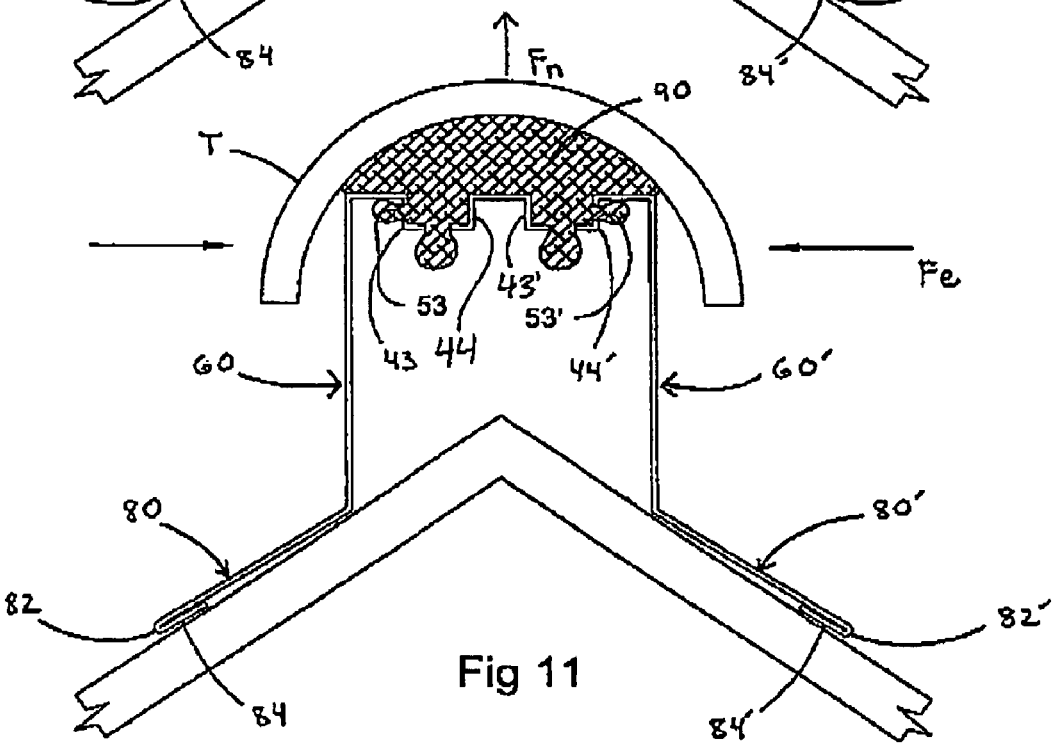
FIG. 11 is an elevational end view of the device shown in FIG. 10 including additionally through openings in the lateral walls.

In FIG. 10, a cross-sectional view of the attachment device shown in FIG. 1 is shown with tile T mounted over a mass of mortar or adhesive compound 90. The mortar is extruded through openings 48 in bottom walls 49 and 49'. When cured, an enhanced structural engagement results. In FIG. 11, transversal through openings 53 and 53' result in the extrusion of the mortar through lateral walls 43; 43'; 44 and 44' providing added shear strength to the anchorage structure. When the mortar or adhesive compound cures, they extend transversely to lock device 10 to the mass of the mortar or adhesive compound 90. In this manner, the anchorage of device 10 withstands uplift as well as lateral loads, $F_u$ and $F_c$.

Folded ends 82 and 82' are designed to avoid sharp edges that may lead to injury in handling devices 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for roof structures having a ridge or hip defined by the planes of two roof decks, disposed at an angle with respect to each other and defining a longitudinal joint, comprising:

A) an elongated cover having at least one elongated channel, and each of said at least one elongated channel defined by a coextensive longitudinally extending bottom wall, two perpendicular and coextensive longitudinally extending lateral walls, and two coextensive longitudinally extending spacer walls, and said elongated cover including first and second longitudinal bends and said bottom wall of said at least one channel including a plurality of through openings and said cover being mounted over ridge or hip;

B) first and second elongated walls extending, respectively, from said first and second longitudinal bends substantially perpendicularly to the plane of said cover, and said first and second elongated walls being kept at a substantially parallel and spaced apart relationship with respect to each other, each of said first and second elongated walls including a coextensive longitudinal flange with respective longitudinal ends, said flanges extending at a predetermined angle with respect to said first and second elongated walls that cooperate with the decks of a roof that form a ridge or hip, said flanges being rigidly mounted to said decks;

C) adhesive compound means positioned within said elongated channel and over said cover to support a tile thereon and said adhesive compound means being extended through, said through openings to enhance the engagement of said bottom walls to said adhesive compound means.

2. The device set forth in claim 1, wherein said lateral walls further include a plurality of through openings to permit said adhesive compound means to protrude therethrough thereby forming an anchorage structure with said lateral walls.

3. The device set forth in claim 2 wherein said longitudinal ends of said flanges terminate with end folds.

4. The device set forth in claim 1 wherein said spacer walls include a plurality of through openings to permit said adhesive compound means to protrude therethrough thereby forming an anchorage structure with said spacer walls.

5. The device set forth in claim 4 wherein said longitudinal ends of said flanges terminate with end folds.

6. The device set forth in claim 1 wherein said lateral and spacer walls include a plurality of through openings to permit said adhesive compound means to protrude therethrough thereby forming an anchorage structure with said lateral and spacer walls.

* * * * *